US008783323B2

(12) United States Patent
Takahashi

(10) Patent No.: US 8,783,323 B2
(45) Date of Patent: Jul. 22, 2014

(54) PLATEN OPENING MECHANISM IN PORTABLE LABELING MACHINE

(75) Inventor: Yoshisada Takahashi, Tokyo (JP)

(73) Assignee: Sato Holdings Kabushiki Kaisha (JP)

( * ) Notice: Subject to any disclaimer, the term of this patent is extended or adjusted under 35 U.S.C. 154(b) by 33 days.

(21) Appl. No.: 13/579,629

(22) PCT Filed: Apr. 28, 2010

(86) PCT No.: PCT/JP2010/003050

§ 371 (c)(1),
(2), (4) Date: Aug. 17, 2012

(87) PCT Pub. No.: WO2011/104768

PCT Pub. Date: Sep. 1, 2011

(65) Prior Publication Data

US 2012/0312476 A1 Dec. 13, 2012

(30) Foreign Application Priority Data

Feb. 23, 2010 (JP) ..... 2010-037612

(51) Int. Cl.
*B65C 11/02* (2006.01)
*B65C 11/00* (2006.01)

(52) U.S. Cl.
USPC ..... 156/577; 156/384; 156/579

(58) Field of Classification Search
USPC ..... 156/574, 577, 579, 384
See application file for complete search history.

(56) References Cited

U.S. PATENT DOCUMENTS

| | | | | |
|---|---|---|---|---|
| 3,741,847 | A | 6/1973 | Sato | 156/384 |
| 4,176,603 | A | 12/1979 | Sato | 101/291 |
| 4,452,667 | A * | 6/1984 | Chang | 156/384 |
| 4,820,064 | A * | 4/1989 | Sato et al. | 400/120.16 |
| 4,826,558 | A * | 5/1989 | Wada et al. | 156/384 |
| 5,013,388 | A * | 5/1991 | Goodwin et al. | 156/384 |
| 8,141,610 | B2 * | 3/2012 | Tharp | 156/579 |

FOREIGN PATENT DOCUMENTS

| | | |
|---|---|---|
| JP | 49-11697 | 1/1974 |
| JP | 50-9560 B1 | 4/1975 |
| JP | 61-130068 | 6/1986 |
| JP | 63-38 A | 1/1988 |
| JP | 2009-274282 A | 11/2009 |

OTHER PUBLICATIONS

International Search Report dated Jun. 15, 2010 issued in corresponding international application No. PCT/JP2010/003050.
Office Action dated Dec. 10, 2013 issued in corresponding Japanese Patent Application No. 2010-037612 with English translation.
Singapore Search Report and Written Opinion dated Oct. 2, 2013.

* cited by examiner

*Primary Examiner* — Mark A Osele
(74) *Attorney, Agent, or Firm* — Ostrolenk Faber LLP

(57) ABSTRACT

Disclosed is a platen opening mechanism in a portable labeling machine capable of simultaneously opening the platen through a single operation of opening a bottom cover to form an insertion passage for a label strip. The platen is pivotally opened from a machine side plate in interlock with opening a bottom cover that is also pivoted open in the opposite pivot direction from the side plate. The platen is pivotable to a closed position and an open position relative to the side plate to allow the label strip to be loaded.

12 Claims, 13 Drawing Sheets

PLATEN OPENING MECHANISM IN PORTABLE LABELING MACHINE

CROSS-REFERENCE TO RELATED APPLICATIONS

The present application is a 35 U.S.C. §§371 national phase conversion of PCT/JP2010/003050, filed Apr. 28, 2010, which claims priority of Japanese Application No. 2010-037612, filed Feb. 23, 2010, the contents of which are incorporated by reference herein. The PCT International Application was published in the Japanese language.

TECHNICAL FIELD

The present invention relates to a platen opening mechanism in a portable labeling machine, particularly, in a portable labeling machine that is loaded with a strip form label strip to be transferred for attachment to a d selected member.

BACKGROUND ART

A portable labeling machine has been used to attach labels to various goods or other members to be attached with to indicate prices of the goods or other information. An example of this portable labeling machine is briefly described with reference to FIGS. 12 and 13. FIG. 12 is a side view of a conventional portable labeling machine 1, t having a pair of left and right (front and back of the paper) side plates 2, a retaining portion 4 for a label 3, an operation lever 5, a transfer portion 6, a printing portion 7, a peel-off portion 8, and an attachment portion 9.

The pair of left and right side plates 2 are integrally formed with a grip 10 graspable by the operator so that the operation lever 5 can be pivotally operated around a pivot 11 relative to the grip 10.

The label strip 3 has a plurality of label pieces 13 temporarily attached to a backing strip form mount 12 which is wound into a roll for the retention by the retaining portion 4. In accordance with the operation of the operation lever 5, the label strip 3 is drawn out in a strip form by the transfer portion 6 toward the printing portion 7 so that the label pieces 13 can be peeled off from the mount 12 by the peel-off portion 8 and then the label pieces 13 can be attached to another member (not shown) by the attachment portion 9.

The retaining portion 4 has a pair of left and right retaining plates 14 fitted to the top surfaces of the pair of left and right side plates 2 in such a manner that either of the retaining plates 14 can be pivoted or opened from either of the side plates 2 so that the rolled label strip 3 can be retained between the pair of left and right retaining plates 14.

The transfer portion 6 has a transfer roller 16 that rotates around a roller shaft 15 and allows the transfer roller 16 to rotate around the roller shaft 15 by a predetermined pitch via a link mechanism (not depicted) to enable a transfer of the label strip 3, by an operator grasping the operation lever 5 together with the grip 10.

The printing portion 7 has a print unit 17 fitted to the extremity of a forked yoke portion 5A of the operation lever 5, a platen 18 that is pivotally openable around the roller shaft 15, and an ink roller 19, the ink roller 19 applying ink onto types of the print unit 17 to print predetermined information on the label piece 13 then transferred to the top surface of the platen 18.

The label peel-off portion 8 has a peel-off pin 20 disposed downstream of the platen 18 so that only the mount 12 is turned backward at the peel-off pin 20 to peel off the label piece 13 from the mount 12.

The attachment portion 9 has an attachment roller 21 positioned at a lower portion of the extremities of the side plates 2 so that the label piece 13 peeled off by the peel-off portion 8 can be attached to a member. This attachment roller 21 is pivotable around an opening/closing shaft 22.

A bottom cover 23 is disposed at a lower portion of the pair of left and right side plates 2 in such a manner as to be pivotally openable around the opening/closing shaft 22 for loading the label 3 into the portable labeling machine 1. The bottom cover 23 has at its extremity at an end opposite to the opening/closing shaft 22 a knob 24 for opening and closing.

The operation of loading the label strip 3 into portable labeling machine 1 is described with reference to FIG. 13. FIG. 13 is a side view depicting the operation of loading the label strip 3 from the state depicted in FIG. 12. FIG. 13 (*a*) is a partially cut-away side view of a principal part depicting a state where the bottom cover 23 is opened from the side plates 2 and FIG. 13 (*b*) is a side view of the principal part depicting a state where the platen 18 is opened further from its state in FIG. 13 (*a*). As depicted in FIG. 13(1), the operator of the machine 1 catches the extremity at the knob 24 of the bottom cover 23 on a fingertip F to pivotally open the bottom cover 23 around the opening/closing shaft 22. The operator then catches the extremity or the end having the peel-off pin 20 of the platen 18 on the fingertip F to pivotally open the platen 18 around the roller shaft 15.

Thus, as depicted in FIG. 13 (*b*), an insertion passage 25 for the label strip 3 is formed between the transfer roller 16 and the opening/closing shaft 22 at the bottom of the pair of left and right side plates 2. The label strip 3 drawn out in a strip form from the retaining portion 4 is inserted into the insertion passage 25. The platen 18 is pivotally closed to its original position. The bottom cover 23 is also pivotally closed to its original position, to thereby complete the loading of the label strip 3 into the portable labeling machine 1.

However, insertion of the label strip 3 needs two operations of opening the bottom cover 23 and then opening the platen 18 as described above. Hence, there is a problem that even though an operator unfamiliar with the use of the portable labeling machine 1 can easily perform the operation for pivotally opening the bottom cover 23, the operator may not know the following operation for opening the platen 18 and consequently may not be able to insert the label 3.

Another problem is that even though the operator knows to open the platen 18 by catching its extremity with the fingertip F, the fingertip F is hard to insert and the opening operation of the platen 18 is hard to perform due to the narrow space between the extremity of the platen 18 or the peel-off pin 20 and the opening/closing shaft 22 or the peel-off roller 21. There is also a problem that when the fingertip F accidentally enters from the extremity of the platen 18 far into the interior portion of the side plates 2, the fingertip may contact the ink roller 19 and become dirty, or a problem that since a stamping operation by the print unit 17 is sometimes carried out by grasping the operation lever 5 in the state when the label strip 3 is not passing along the top surface of the platen 18, the top surface of the platen 18 may be made dirty with ink and the top of the fingertip F may become dirty when performing the operation for opening the platen 18.

It is also demanded that when the label strip 3 is loaded into the portable labeling machine 1, the operator can freely select the opening state or the opening position of the platen 18 to facilitate the loading operation irrespective of the opening position of the bottom cover 23.

A similar problem on loading of the label strip 3 still remains in a portable labeling machine configured such that when attaching a label 3 having sales promotion information or advertisement information printed in advance thereon, the label piece 13 of the label strip 3 can be peeled off and attached by only the operation of the operation lever 5 without being provided with the print unit 7.

SUMMARY OF THE INVENTION

Technical Problem

The present invention was conceived in view of the above problems. It is therefore an object to provide a platen opening mechanism in a portable labeling machine capable of opening a platen at the same time by only a single operation of opening a bottom cover.

An object of the present invention is to provide a platen opening mechanism in a portable labeling machine allowing an operator unfamiliar with use of the portable labeling machine to simply form a label insertion passage.

An object of the present invention is to provide a platen opening mechanism in a portable labeling machine enabling the platen to be opened in response to the opening of the bottom cover to facilitate a further platen opening operation.

An object of the present invention is to provide a platen opening mechanism in a portable labeling machine enabling the platen to be opened in response to the opening of the bottom cover so that the platen opening operation is facilitated without forcibly catching the extremity of the platen in closed state by the fingertip.

An object of the present invention is to provide a platen opening mechanism in a portable labeling machine enabling the platen to be opened in response to the opening of the bottom cover so that the label handling and the loading operation are facilitated by optionally selecting the platen opening position irrespective of the state of the bottom cover.

Means for Solving the Problems

Solution to Problem

The present invention focuses on that the platen being opened from the side plates in interlock with the operation of opening the bottom cover from the side plates. A first invention is a platen opening mechanism in a portable labeling machine, comprising a side plate having a bottom cover disposed in a pivotally openable manner. A retaining portion retains a label strip wound into a roll at the side plate. A platen enables the label strip, drawn out in strip form from the retaining portion, to be transferred onto a top surface of the platen. Each label, when removed from the strip, is attachable to a member. The platen is pivotable to a closed position and to an open position relative to the side plate to allow the label to be loaded into the portable labeling machine. The platen is put in an open state relative to the side plate accompanied by opening the bottom cover from the side plate.

A second invention is configured such that a printing portion is disposed in the portable labeling machine of the first invention. The second invention is a platen opening mechanism in a portable labeling machine, comprising a side plate having a bottom cover disposed in a pivotally openable manner. A retaining portion retains a label strip wound into a roll at the side plate. A printing portion includes a print unit that prints each label drawn out in strip form from the retaining portion and includes a platen confronting the print unit for enabling the label to be transferred onto a top surface of the platen. The label printed by the printing portion is attachable to a member. The platen is pivotable to a closed position and to an open position relative to the sideplate to allow the label strip to be loaded into the portable labeling machine. The platen is put in an open state relative to the side plate accompanied by opening the bottom cover from the side plate.

The bottom cover may be formed with a platen-opening engagement/disengagement portion that is engageable with and disengageable from a flange portion protrudingly formed on the platen.

The flange portion may have on its top surface portion a top-surface engagement/disengagement surface. The platen-opening engagement/disengagement portion may have on its inward portion an undersurface engagement/disengagement surface. The undersurface engagement/disengagement surface may come into sliding contact with the top surface engagement/disengagement surface of the flange portion accompanied by an operation of opening the bottom cover from the side plate, and opening the platen.

The flange portion may have a flange taper surface with a tapered extremity. The platen-opening engagement/disengagement portion may have an engagement/disengagement taper surface with a tapered extremity. The engagement/disengagement taper surface may be engageable with and disengageable from the flange taper surface accompanied by an operation of opening the bottom cover from the side plate.

The platen-opening engagement/disengagement portion may disengage from the flange portion in a state where the platen is opened from the side plate.

The open position of the platen may be adjustable by selecting a length of the flange portion in the platen.

The open position of the platen may be adjustable by selecting relative positions of the flange portion and the platen-opening engagement/disengagement portion of the bottom cover.

The platen may be openable and closable between a first stopper and a second stopper that are formed on the side plate.

The platen may be pivotable along a guide groove formed in the side plate.

The platen may be openable and closable among the closed position in the side plate, a first open position as a result of opening the bottom cover, and a second open position arrived at by further opening the platen itself from the first open position.

The platen and the bottom cover may be opened and closed in opposite directions to each other.

Any internal configuration may be employed for forming the insertion passage in accompaniment with the opening of the platen.

Advantageous Effect of Invention

The platen opening mechanism in a portable labeling machine according to the present invention is configured such that the platen is brought into its open state (the first open position) in interlock with the operation of opening the bottom cover relative to the side plate, so that a sufficient space is secured between the extremity of the platen and the attachment roller of the attachment portion, making it possible without dirtying the fingertip with ink to easily open the platen further and to easily form the insertion passage for loading the label strip into the portable labeling machine.

According to the platen opening mechanism in a portable labeling machine of the first invention in particular, the operation of loading the label strip into the portable labeling machine can be facilitated irrespective of the presence or absence of the label printing operation.

According to the platen opening mechanism in a portable labeling machine of the second invention in particular, the loading of the label into the portable labeling machine for the execution of the label printing can be facilitated.

DESCRIPTION OF EMBODIMENTS

The present invention is configured such that a platen is opened from side plates in response to opening a bottom cover from the side plates, thereby implementing a platen opening mechanism in a portable labeling machine capable of opening the platen by a single operation of opening the bottom cover. As one possible result, the number of components can be reduced and the operator can easily open the platen.

Embodiment

Figure 1:
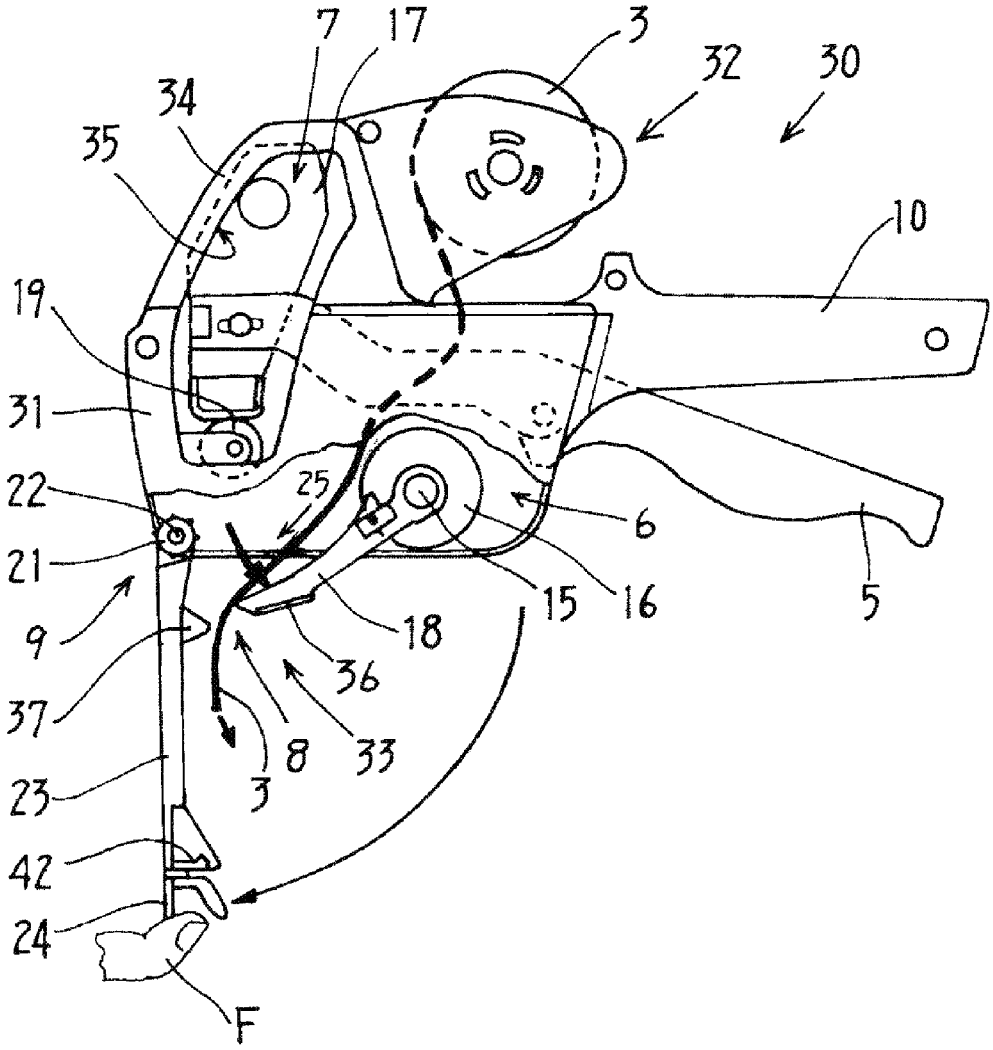
FIG. 1 is a partially cut-away side view of a principal part of a portable labeling machine 30 having a platen opening mechanism 33 according to an embodiment of the present invention, with a bottom cover 23 being in an open state and a platen 18 being in an open state (a first open position).
Figure 12:
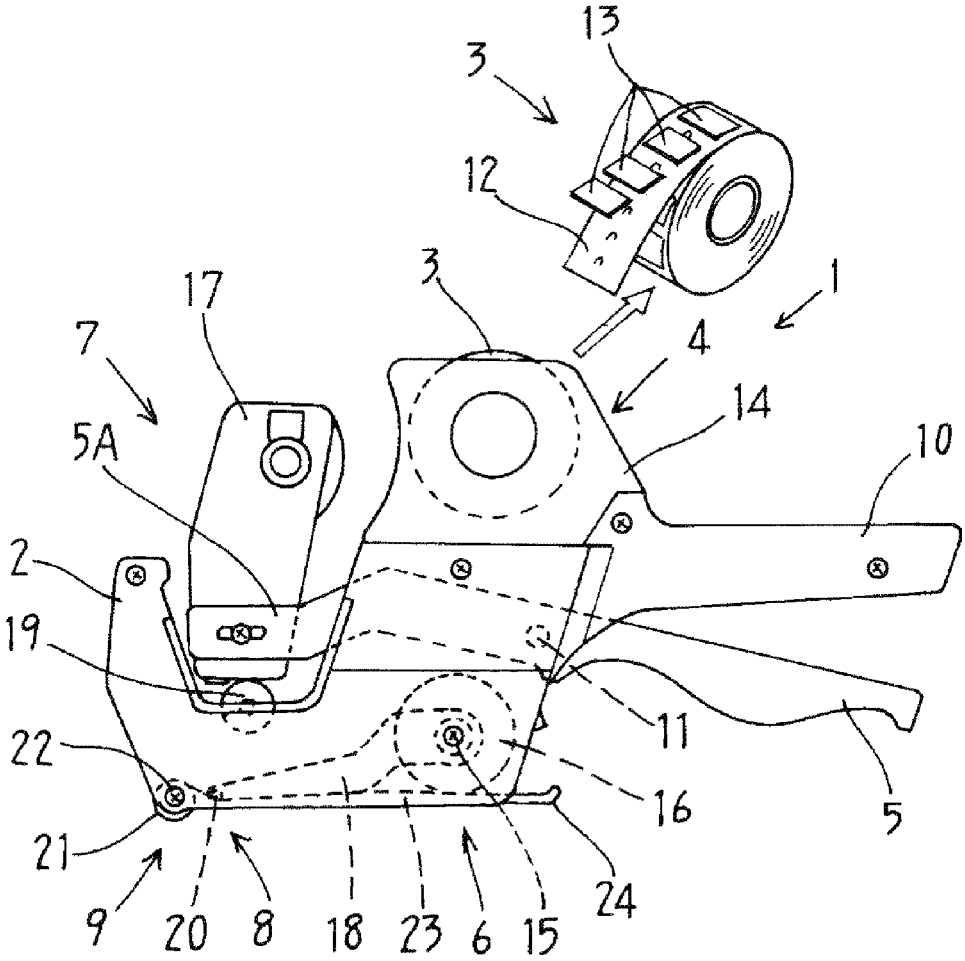
FIG. 12 is a side view of a conventional portable labeling machine 1.
Figure 13A:
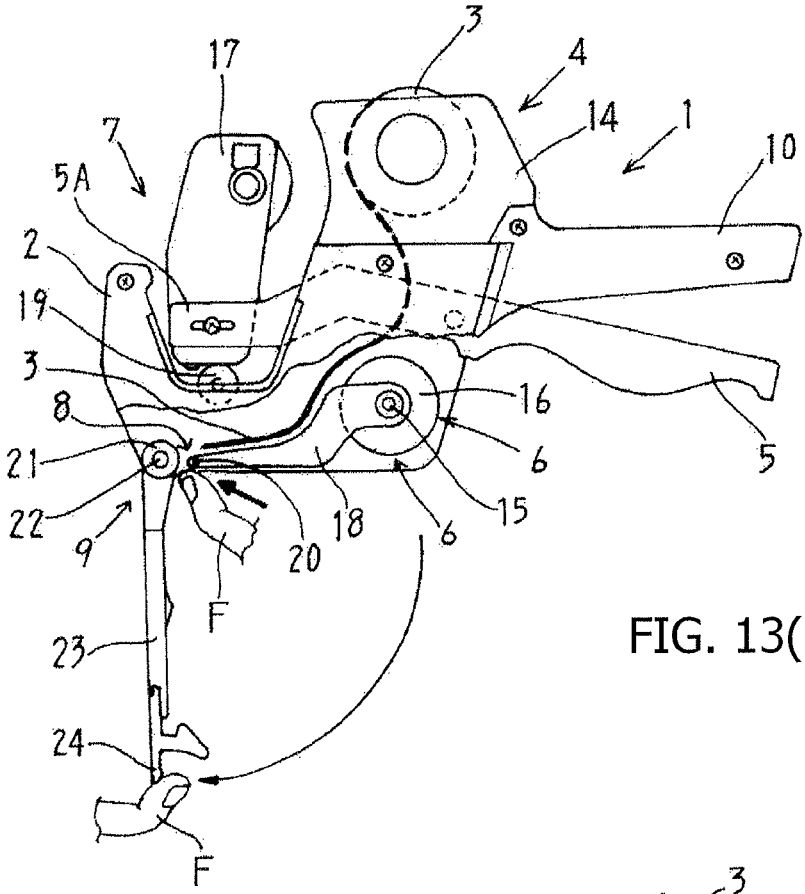
FIG. 13 is a side view of a principal part depicting an operation of loading a label 3 from the state depicted in FIG. 12, FIG. 13 (*a*) being a partially cut-away side view of the principal part depicting a state where the bottom cover 23 is opened from the side plates 2 and FIG. 13 (*b*) is a side view of the principal part depicting a state where the platen 18 is opened further from the state of FIG. 13 (*a*).
Figure 13B:
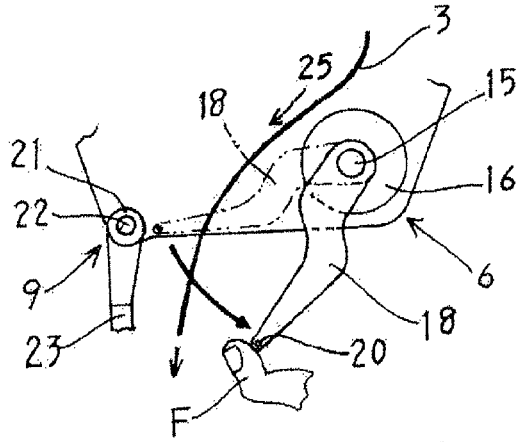

A platen opening mechanism in a portable labeling machine according to an embodiment of the present invention will now be described with reference to FIGS. 1 to 11. Note that portions similar to those of FIGS. 12 and 13 are denoted by the same reference numerals and will not again be described. FIG. 1 is a partially cut-away side view of a principal part of a portable labeling machine 30 having the platen opening mechanism, with a bottom cover 23 being in an open state and a platen 18 being in an open state (a first open position, described later). Similar to the portable labeling machine 1 (FIG. 12), the portable labeling machine 30 includes a pair of left and right side plates 31 corresponding to the pair of left and right (front and back of the paper) side plates 2; a retaining portion 32 corresponding to the retaining portion 4 for the label strip 3; the operation lever 5; the transfer portion 6; the printing portion 7; the label peel-off portion 8; the attachment portion 9; and the platen opening mechanism 33.

The pair of left and right side plates 31 integrally have the label strip retaining portion 32 and a guard portion 34 that guards the printing portion 7 and have the bottom cover 23 pivotable around the opening/closing shaft 22 in a pivotally openable manner. The pair of left and right side plates 31 are each formed with a window portion 35 extending from the retaining portion 32 to the guard portion 34 or extending between the retaining portion 32 and the guard portion 34. The window portion 35 allows right and left side surfaces of the printing portion 7 and the ink roller 19 to be viewable from the exterior. The retaining portion 32 retains the label strip 3 wound into a roll at the pair of left and right side plates 31.

In response to an operation of opening the bottom cover 23 from the side plates 31, the platen opening mechanism 33 puts the platen 18 into an open state (a first open position, described later) from the side plates 31.

Figure 2:
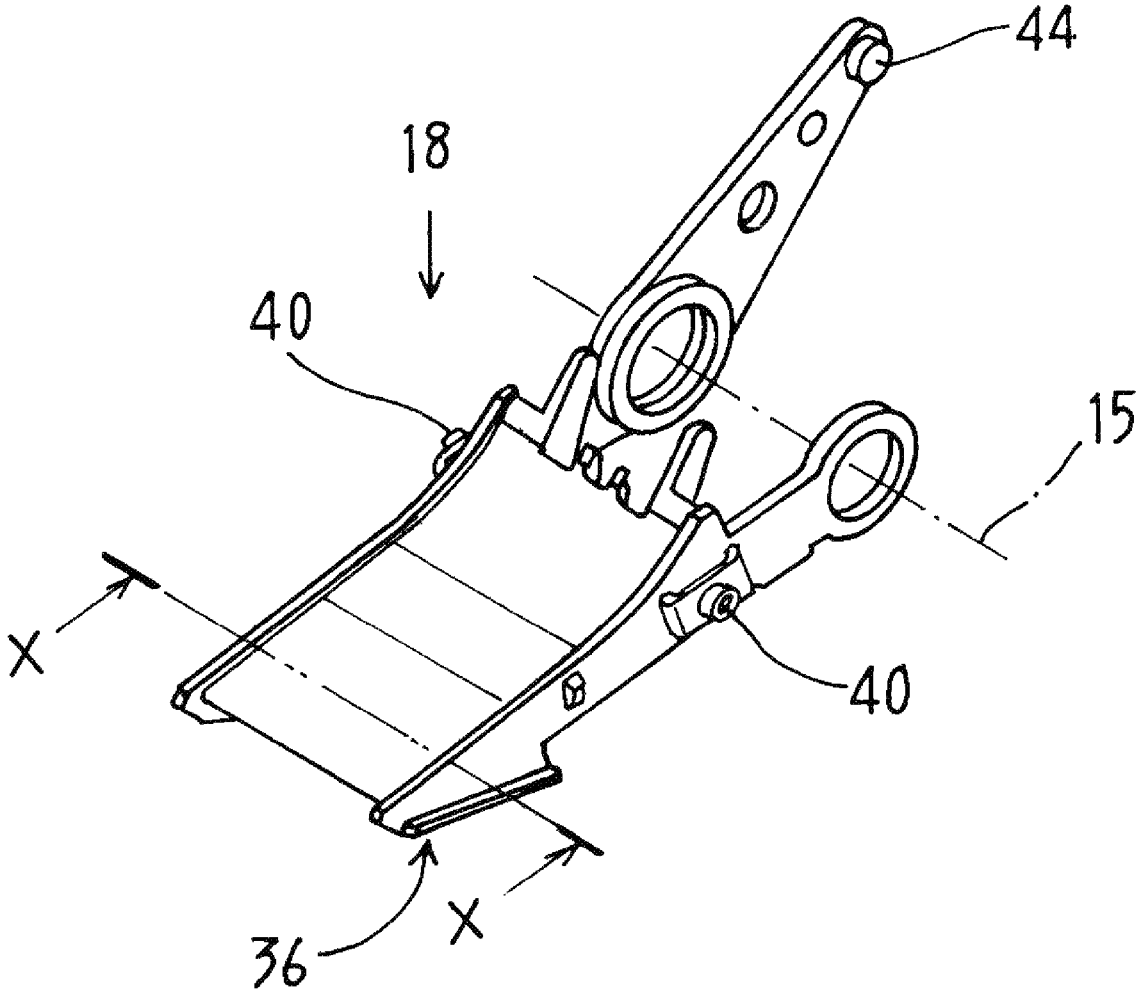
FIG. 2 is a perspective view of the platen 18.
Figure 3:
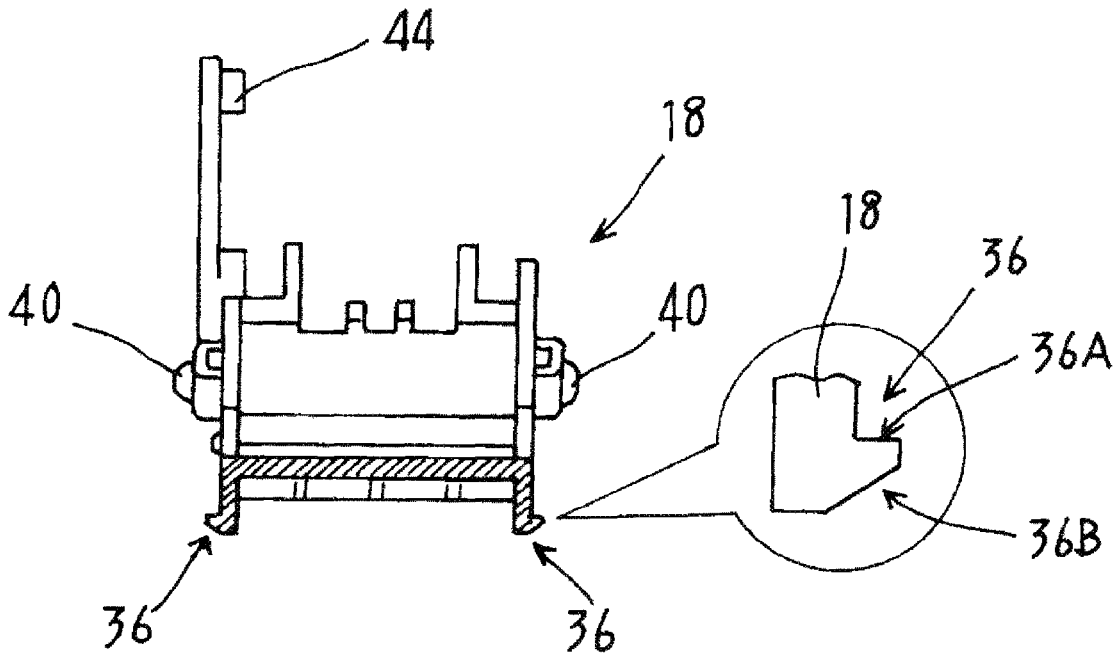
FIG. 3 is a sectional view taken along line X-X of FIG. 2.

FIG. 2 is a perspective view of the platen 18 and FIG. 3 is a sectional view taken along line X-X of FIG. 2. The platen 18 has at its left and right ends a flange portion 36 protruding over a predetermined length and width in the direction where the label 3 is transferred. The flange portion 36 has at its top surface a top-surface engagement/disengagement surface 36A and has at its undersurface side a flange taper surface 36B whose extremity is tapered.

Figure 4:
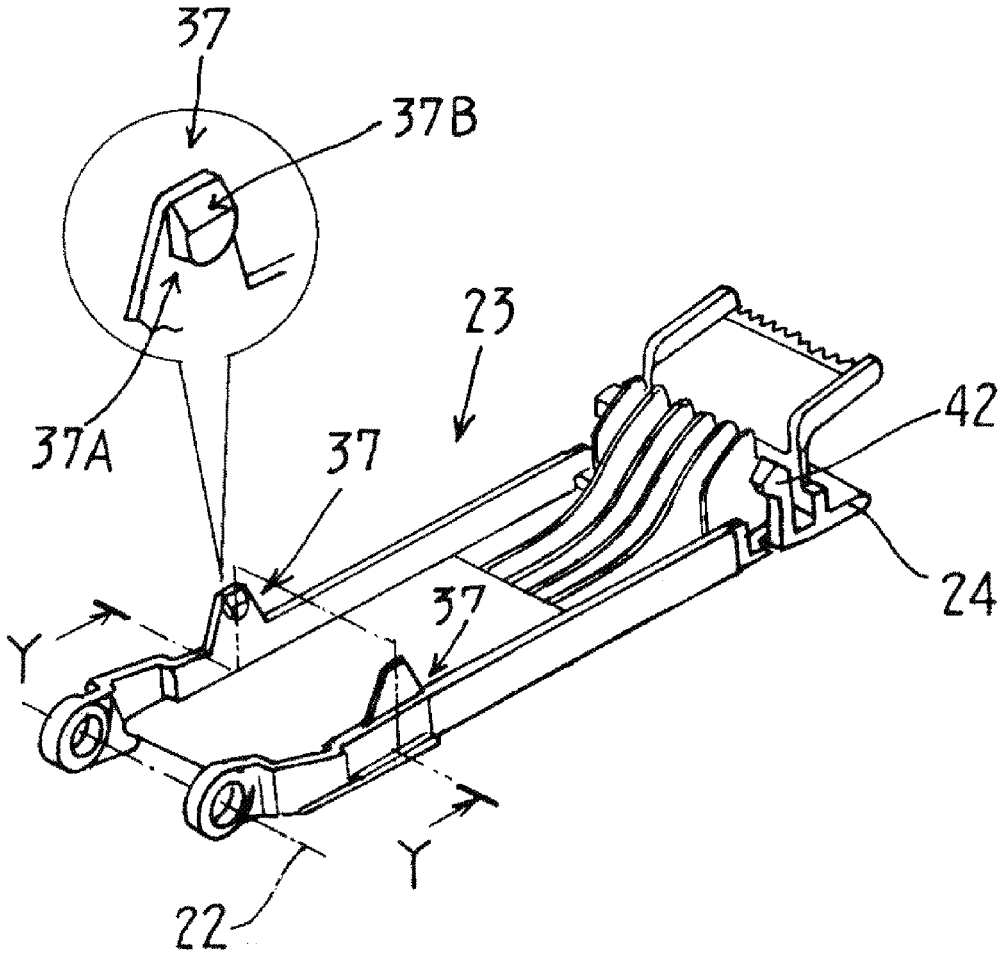
FIG. 4 is a perspective view of the bottom cover 23.
Figure 5:
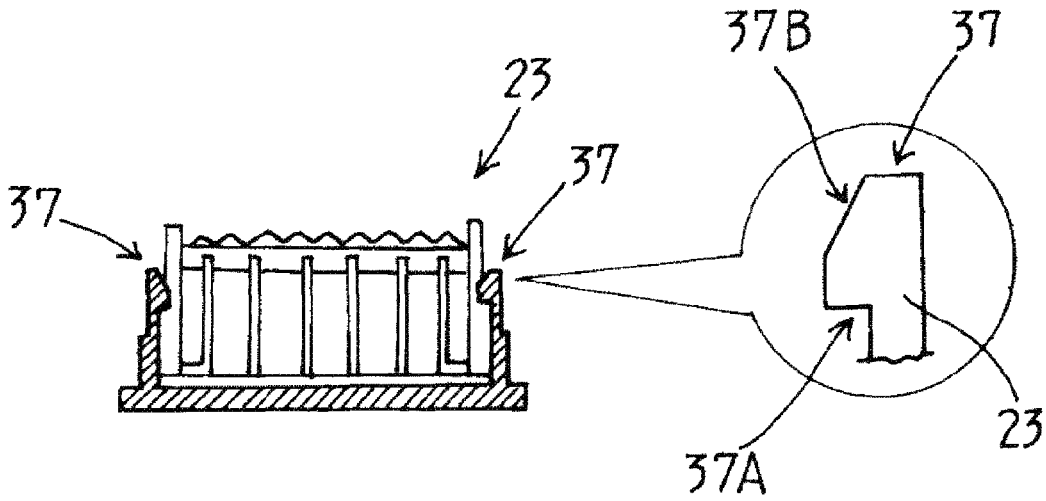
FIG. 5 is a sectional view taken along line Y-Y of FIG. 4.

FIG. 4 is a perspective view of the bottom cover 23 and FIG. 5 is a sectional view taken along line Y-Y of FIG. 4. The bottom cover 23 is formed with a hook-shaped platen-opening engagement/disengagement portion 37 protruding toward the flange portion 36 of the platen 18. The platen-opening engagement/disengagement portion 37 is engageable with and disengageable from the flange portion 36 formed protrudingly on the platen 18. The platen-opening engagement/disengagement portion 37 presents a substantially triangular shape positioned and formed confronting the flange portion 36 on the side of the opening/closing shaft 22 of the bottom cover 23. The platen-opening engagement/disengagement portion 37 has at its interior portion an undersurface engagement/disengagement surface 37A and having at its top surface side an engagement/disengagement taper surface 37B whose extremity is tapered.

The platen 18 and the bottom cover 23 may be opened or closed in the opposite directions to each other. More specifically, as depicted in FIG. 1 in particular, the platen 18 is pivotally opened counterclockwise around the roller shaft 15 and is pivotally closed in the clockwise direction. On the other hand, the bottom cover 23 is pivotally opened clockwise around the opening/closing shaft 22 and is pivotally closed in the counterclockwise direction.

Figure 6:
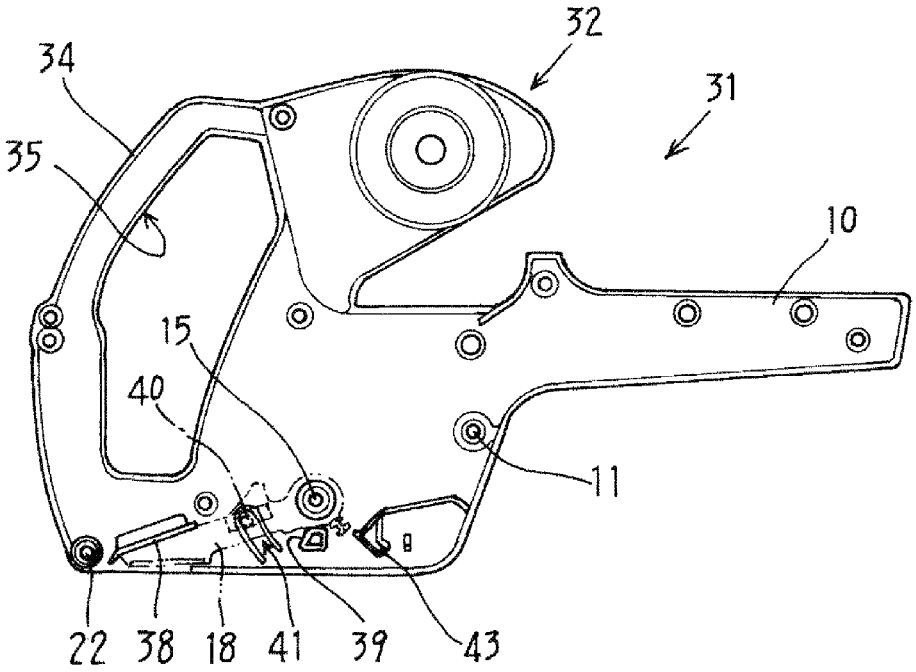
FIG. 6 is a side view of the side plate 31 on one hand depicting an inner wall surface thereof.

FIG. 6 is a side view of the side plate 31 on one hand depicting an inner wall surface thereof. The platen 18 is openable and closable between a first stopper 38 and a second stopper 39 formed on the side plate 31. The first stopper 38 functions also as a label press bar for pressing the top surface of the label strip 3 transferred onto the platen 18 to prevent the label strip 3 from fluttering during the transfer. The platen 18 has at its side surfaces a guide projection 40 (FIG. 2) fitted in an arcuate guide groove 41 formed in the side plates 31 so as to be pivotable along the guide groove 41. Thus, the platen 18 is allowed to open or close among a closed position (the position of the first stopper 38, esp., the position depicted in FIGS. 7 and 8) in the side plates 31, a first open position (a halfway position between the position of the first stopper 38 and the position of the second stopper 39) depending on the opening operation of the bottom cover 23, and a second open position (the position of the second stopper 39, esp., the position depicted in FIG. 11) as a result of fully opening the platen 18 itself to the end.

As depicted in FIG. 4 in particular, the bottom cover 23 is formed with an engagement piece 42 for opening and closing that is engageable with an engagement projection 43 (FIG. 6) for opening and closing formed on the inner wall surfaces of the pair of left and right side plates 31 by operating the knob 24 for opening and closing, to thereby secure the closed state of the bottom cover 23.

Figure 7:
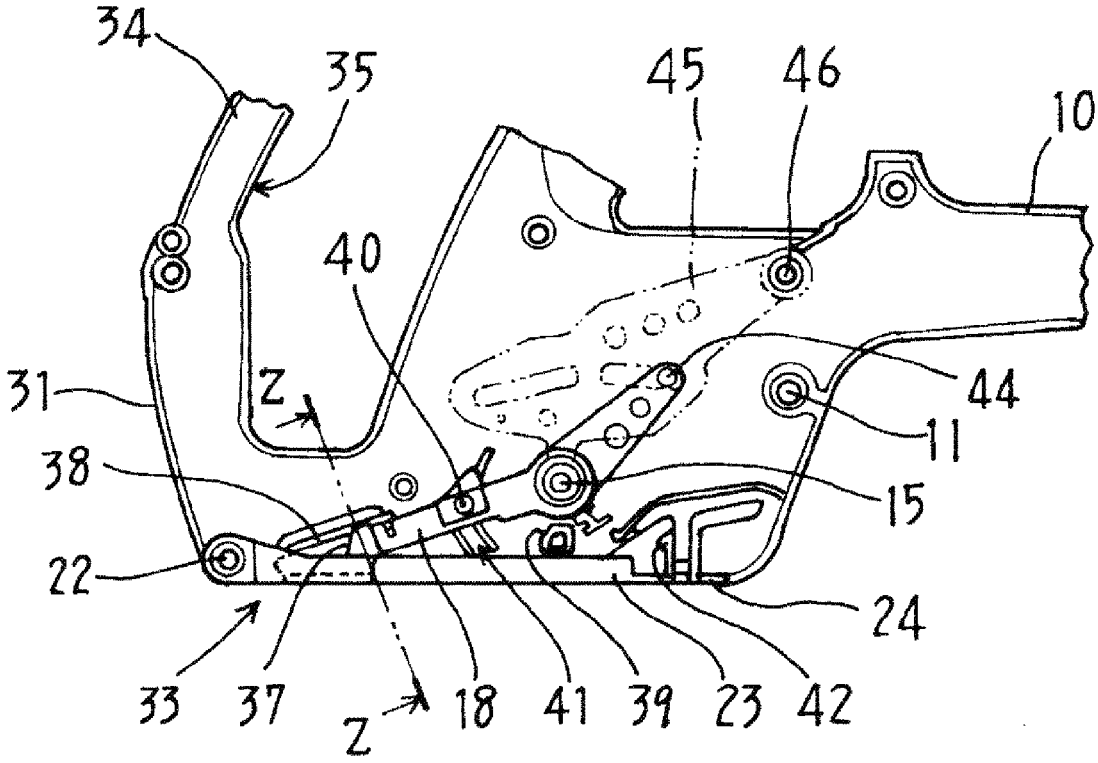
FIG. 7 is a side view of a principal part depicting the closed positions of the bottom cover 23 and the platen 18.
Figure 8:
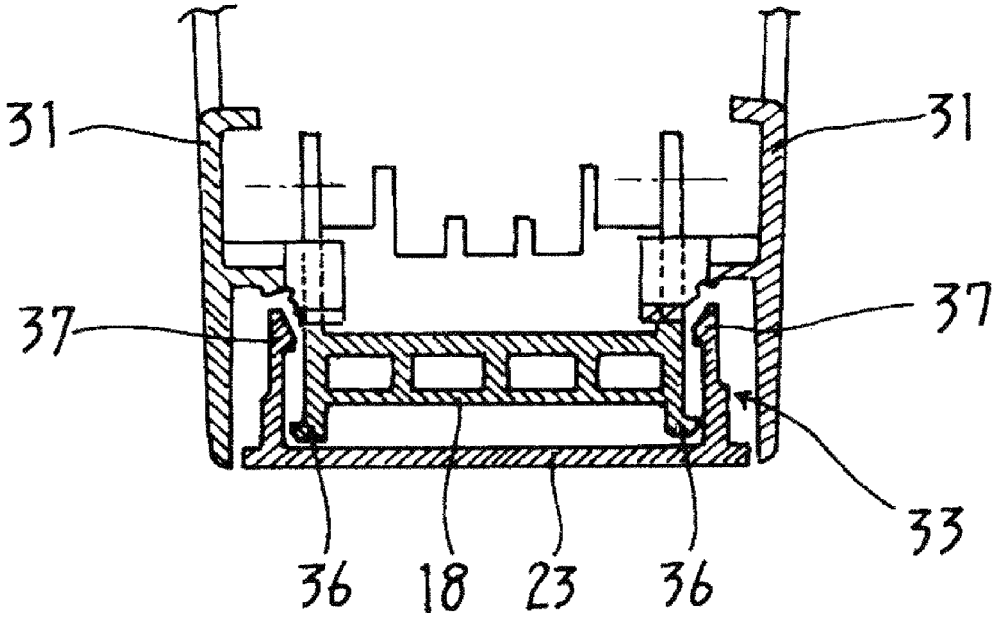
FIG. 8 is a sectional view taken along line Z-Z of FIG. 7.

FIG. 7 is a side view of a principal part depicting the closed states of the bottom cover 23 and the platen 18 and FIG. 8 is a sectional view taken along line Z-Z of FIG. 7. The platen 18 is in abutment with the bottom of the first stopper 38, below which the bottom cover 23 is positioned so that the platen 18 lies in its closed state, with the guide projection 40 located at the deepest portion of the guide groove 41 so that the label strip 3 is transferred along the top surface thereof. A predetermined space is present as depicted in FIG. 8 between the flange portion 36 of the platen 18 and the platen-opening engagement/disengagement portion 37 of the bottom cover 23 so that no interactions work between the bottom cover 23 and the platen 18 in this closed state.

As depicted in FIG. 7 in particular, the platen 18 has at its upper end a coupling projection 44 coupled to a movable guide 45 that is movable around a guide shaft 46 depending on the opening/closing of the platen 18, to thereby enable the insertion passage 25 (FIG. 1) for the label strip 3 to be formed.

In the thus configured portable labeling machine 30 and platen opening mechanism 33, a procedure will be described for opening the bottom cover 23 and opening the platen 18 in interlock therewith to form the insertion passage 25 for the label strip 3 in the portable labeling machine 30.

Figure 9:
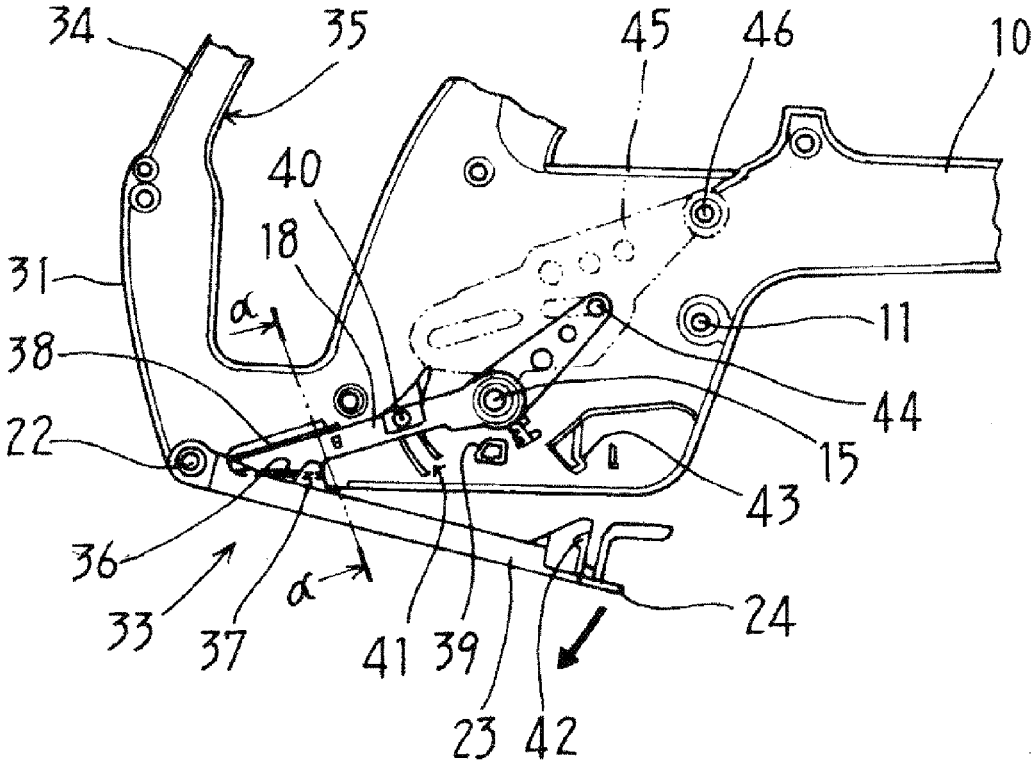
FIG. 9 is a side view of a principal part depicting a state where the bottom cover 23 starts to open as a result of disengaging the engagement piece 42 for opening and closing of the bottom cover 23 from the engagement projection 43 for opening and closing of the side plates 31.
Figure 10:
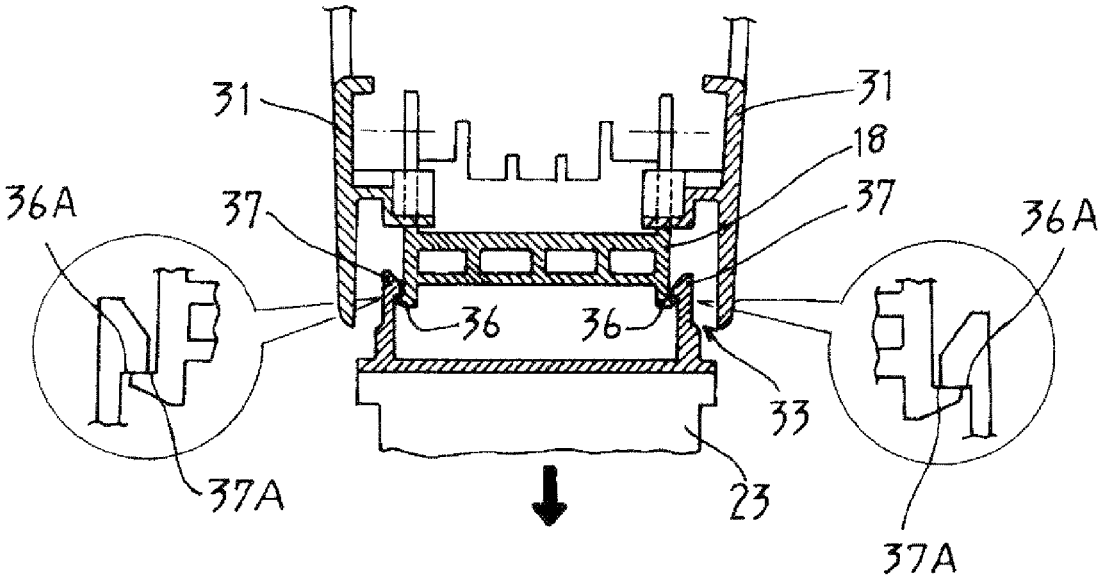
FIG. 10 is a sectional view taken along line α-α of FIG. 9.

FIG. 9 is a side view of a principal part depicting a state where the bottom cover 23 starts to open as a result of disengaging the engagement piece 42 for opening and closing of the bottom cover 23 from the engagement projection 43 for opening and closing of the side plates 31. FIG. 10 is a sectional view taken along line α-α of FIG. 9, in which as depicted in FIG. 9, depending on the opening operation of the bottom cover 23 from the closed state of FIG. 8, the platen-opening engagement/disengagement portion 37 thereof starts to engage with the flange portion 36 of the platen 18. As depicted in FIG. 10 in particular, depending on the opening action of the bottom cover 23, the undersurface engagement/disengagement surface 37A of the platen-opening engagement/disengagement portion 37 of the bottom cover 23 starts to engage the top-surface engagement/disengagement surface 36A of the flange portion 36 of the platen 18.

Further opening the bottom cover 23 causes the undersurface engagement/disengagement surface 37A of the platen-opening engagement/disengagement portion 37 to move in sliding contact with the top-surface engagement/disengagement surface 36A of the flange portion 36 to pivot the platen 18 around the roller shaft 15 in the counterclockwise direction into the first open position. Since the platen-opening engagement/disengagement portion 37 then disengages from the flange portion 36 with the platen 18 being pivoted to the first open position apart from the side plates 31, the platen 18 remains stopped at this first open position even if the bottom cover 23 is further opened (see FIG. 1).

Figure 11:
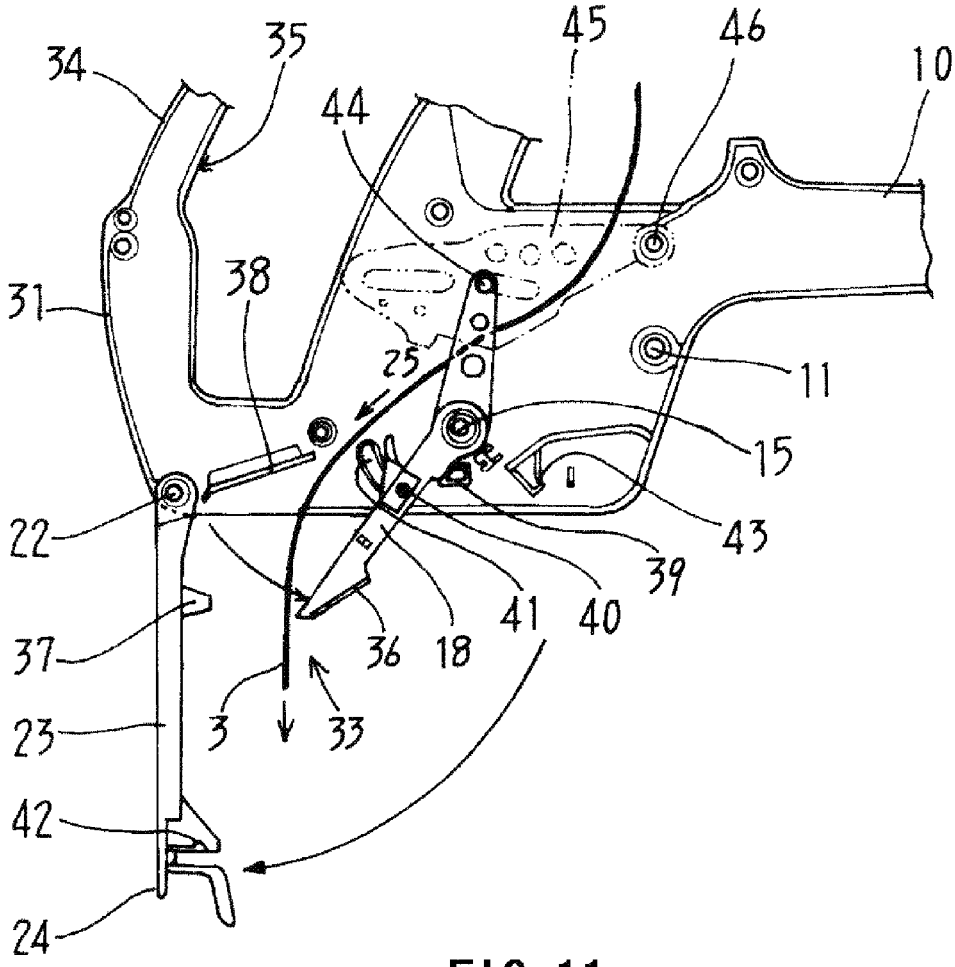
FIG. 11 is a side view of a principal part depicting a state where the platen 18 is further opened to the full (a second open position) with the bottom cover 23 being opened.

FIG. 11 is a side view of a principal part depicting a state where the platen 18 is further opened to the full (the second open position) with the bottom cover 23 being opened. The operator can open the platen 18 up to a full open position (the second open position) by the fingertip F from the first open position obtained by pivoting and opening the platen 18 counterclockwise around the roller shaft 15 while the undersurface engagement/disengagement surface 37A slides along the top-surface engagement/disengagement surface 36A.

Thus, the operator has only to open the bottom cover 23 bringing the platen 18 into a state (the first open position) substantially half opened from the side plates 31, and implementing a preliminary open position for further opening the platen 18 by catching the extremity of the platen 18 with the fingertip or by holding the side surfaces of the platen 18. The platen 18 can be opened up to the second open position by further pivoting the platen 18 to the position in abutment with the second stopper 39.

As described above, by forming the insertion passage 25 inside the side plates 31 and allowing the label strip 3 to be extended in a strip form from the retaining portion 32 therethrough onto the platen 18; by closing the platen 18 clockwise in FIG. 11 up to the closed position; and by operating the bottom cover 23 in the closing direction (the counterclockwise direction) relative to the side plates 31, the engagement/disengagement taper surface 37B of the platen-opening engagement/disengagement portion 37 of the bottom cover 23 engages with the flange taper surface 36B of the flange portion 36 of the platen 18 causing a mutual elastic deformation and allowing the platen-opening engagement/disengagement portion 37 and the flange portion 36 to climb over each other. Consequently, the platen-opening engagement/disengagement portion 37 as depicted in FIG. 8 is positioned inward (upward) of the flange portion 36 and the knob 24 for opening and closing is engaged with the engagement projection 43 for opening and closing, achieving the loaded and closed state. That is, the engagement/disengagement taper surface 37B is engageable with or disengageable from the flange taper surface 36B in response to the operation of closing the bottom cover 23 onto the side plates 31, ensuring an easy return to the closed state.

Thus, the operator can pivot the platen 18 to the opened position (the first open position, see FIG. 1) merely by performing the opening operation of the bottom cover 23, so that even the operator unfamiliar with the operation of the portable labeling machine 30 can easily perceive the next action of catching the extremity of the platen 18 with the fingertip F when seeing the open state of the platen 18, facilitating the operation of further opening the platen 18.

In the present invention, the initial opening degree or open position (the first open position) is adjustable by optionally designing the relative positions of the flange portion 36 and the platen-opening engagement/disengagement portion 37. For example, even though the position of the platen-opening engagement/disengagement portion 37 of the bottom cover 23 is fixed, the open position (the first open position) of the platen 18 is adjustable by selecting the length of the flange portion 36 of the platen 18, esp., the position of the extremity thereof (the position of disengagement of the platen-opening engagement/disengagement portion 37 from the flange portion 36) closer to the opening/closing shaft 22. Similarly, even though the length of the flange portion 36 of the platen 18 is unvaried, the open position (the first open position) of the platen 18 is adjustable by selecting the distance of the platen-opening engagement/disengagement portion 37 of the bottom cover 23 from the opening/closing shaft 22 and selecting the relative position with respect to the flange portion 36.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

REFERENCE SIGNS LIST

1 portable labeling machine (prior art, FIG. 12)
2 a pair of left and right side plates
3 label
4 retaining portion
5 operation lever
5A yoke portion of operation lever 5
6 transfer portion
7 printing portion
8 peel-off portion
9 attachment portion
10 grip
11 pivot
13 strip form mount
13 label piece
14 retaining plate
15 roller shaft
16 transfer roller
17 print unit
18 platen (FIGS. 2 and 3)
19 ink roller
20 peel-off pin
21 attachment roller
22 opening/closing shaft
23 bottom cover (FIGS. 4 and 5)
24 knob for opening and closing of bottom cover 23
25 insertion passage for the label 3
30 portable labeling machine (FIG. 1)
31 a pair of left and right side plates
32 retaining portion
33 platen opening mechanism (embodiment, FIG. 1) in portable labeling machine 30
34 guard portion
35 window portion
36 flange portion (FIGS. 2 and 3) of the platen 18
36A top-surface engagement/disengagement surface of flange portion 36
36B flange taper surface of flange portion 36
37 platen-opening engagement/disengagement portion (FIGS. 4 and 5) of bottom cover 23
37A undersurface engagement/disengagement surface of platen-opening engagement/disengagement portion 37
37B engagement/disengagement taper surface of platen-opening engagement/disengagement portion 37
38 first stopper (FIG. 6) for platen 18 formed on inner wall surfaces of side plates 31
39 second stopper (FIG. 6) for platen 18 formed on inner wall surfaces of side plates 31
40 guide projection of platen 18
41 guide groove formed on inner wall surfaces of side plates 31
42 engagement piece for opening and closing of bottom cover 23
43 engagement projection for opening and closing formed on inner wall surfaces of side plates 31
44 coupling projection of platen 18
45 movable guide
46 guide shaft
F fingertip (FIGS. 1 and 13)

The invention claimed is:

1. A platen opening mechanism in a labeling machine, comprising:

the labeling machine including a side plate, a bottom cover disposed in a pivotally openable and closable manner relative to the side plate;

a retaining portion located and configured for retaining at the side plate a label strip wound into a roll a platen located and configured for enabling the label strip drawn out in a strip form from the retaining portion to be transferred onto a top surface of the platen;

the platen being pivotable to a closed position, and pivotable to an open position relative to the side plate that is sufficient to allow the label strip to be loaded past the platen and into the portable labeling machine, wherein the platen and the bottom cover are located and configured for the platen to be pivoted to the open position relative to the side plate and to be pivoted open in accompaniment with opening of the bottom cover from the side plate;

a flange protruding from the platen; and the bottom cover having a platen-opening engagement/disengagement portion that is engageable with and disengageable from the flange portion.

2. The platen opening mechanism in a labeling machine of claim 1, further comprising:

the flange portion having a top surface portion having a top-surface engagement/disengagement surface, the platen-opening engagement/disengagement portion of the bottom cover has an inward portion having an undersurface engagement/disengagement surface, wherein the undersurface engagement/disengagement surface is located and configured to come into sliding contact with the top surface engagement/disengagement surface of the flange portion during opening of the bottom cover from the side plate, thereby also opening the platen.

3. The platen opening mechanism in a labeling machine of claim 1, wherein the flange portion has a flange taper surface with a first extremity that is tapered and;

the platen-opening engagement/disengagement portion has an engagement/disengagement taper surface with a second extremity that is tapered, wherein the engagement/disengagement taper surface and the flange taper surface are located and configured such that the engagement/disengagement taper surface is engageable with and then disengageable from the flange taper surface during opening of the bottom cover from the side plate.

4. The platen opening mechanism in a labeling machine of claim 1, wherein the engagement/disengagement taper surface and the flange taper surface are located and configured such that the platen-opening engagement/disengagement portion disengages from the flange portion when the platen is opened from the side plate.

5. The platen opening mechanism in a labeling machine of claim 1, wherein the open position of the platen is adjustable depending upon a length of the flange portion of the platen along the direction of relative motion of the platen and the bottom cover during the respective opening thereof.

6. The platen opening mechanism in a labeling machine of claim 1, wherein the open position of the platen is adjustable depending upon relative positions of the flange portion and the platen-opening engagement/disengagement portion of the bottom cover.

7. A platen opening mechanism in a labeling machine, comprising:

the labeling machine including a side plate, a bottom cover disposed in a pivotally openable and closable manner relative to the side plate;

a retaining portion located and configured for retaining at the side plate a label strip wound into a roll a platen located and configured for enabling the label strip drawn out in a strip form from the retaining portion to be transferred onto a top surface of the platen;

the platen being pivotable to a closed position, and pivotable to an open position relative to the side plate that is sufficient to allow the label strip to be loaded past the platen and into the portable labeling machine, wherein the platen and the bottom cover are located and configured for the platen to be pivoted to the open position relative to the side plate and to be pivoted open in accompaniment with opening of the bottom cover from the side plate;

wherein the platen is openable and closable by being movable between a first and a second stopper on the side plate.

8. The platen opening mechanism in a labeling machine of claim 7, wherein the platen is openable and closable with respect to the side plates among positions including the closed position with respect to the side plates, a first open position as a result of a first opening of the bottom cover, and a second open position arrived at as a result of further opening the platen from the first open position thereof.

9. The platen opening mechanism in a labeling machine of claim 7, wherein the platen and the bottom cover are opened and closed in opposite directions to each other.

10. A platen opening mechanism in a labeling machine, comprising:

the labeling machine including a side plate, a bottom cover disposed in a pivotally openable and closable manner relative to the side plate;

a retaining portion located and configured for retaining at the side plate a label strip wound into a roll a platen located and configured for enabling the label strip drawn out in a strip form from the retaining portion to be transferred onto a top surface of the platen;

the platen being pivotable to a closed position, and pivotable to an open position relative to the side plate that is sufficient to allow the label strip to be loaded past the platen and into the portable labeling machine, wherein the platen and the bottom cover are located and configured for the platen to be pivoted to the open position relative to the side plate and to be pivoted open in accompaniment with opening of the bottom cover from the side plate;

a guide groove formed in the side plate engaged by the platen and along which the platen is pivotable.

11. The platen opening mechanism in a labeling machine of claim 10, wherein the platen is openable and closable with respect to the side plates among positions including the closed position with respect to the side plates, a first open position as a result of a first opening of the bottom cover, and a second open position arrived at as a result of further opening the platen from the first open position thereof.

12. The platen opening mechanism in a labeling machine of claim 10, wherein the platen and the bottom cover are opened and closed in opposite directions to each other.

* * * * *